US005483042A

United States Patent [19]

Sprenger et al.

[11] Patent Number: 5,483,042

[45] Date of Patent: Jan. 9, 1996

[54] MAGNETIC SEPARATOR

[75] Inventors: Robert A. Sprenger, Felton; Ray C. Raffa, San Jose, both of Calif.

[73] Assignee: Nordson Corporation, Westlake, Ohio

[21] Appl. No.: 984,174

[22] Filed: Nov. 20, 1992

Related U.S. Application Data

[63] Continuation-in-part of Ser. No. 832,987, Feb. 10, 1992, which is a continuation-in-part of Ser. No. 621,231, Nov. 30, 1990, abandoned, which is a continuation-in-part of Ser. No. 532,945, Jun. 4, 1990, abandoned.

[51] Int. Cl.[6] ..... H05B 6/22

[52] U.S. Cl. ..... 219/647; 219/653; 219/657; 198/690.1; 209/609

[58] Field of Search ..... 219/10.75, 10.79, 219/10.61 R, 10.43, 10.69, 647, 657, 653, 654, 658, 632, 648, 645; 34/23; 186/379.7; 209/609, 552, 636, 930, 905; 414/96, 117, 120; 198/690.1

[56] References Cited

U.S. PATENT DOCUMENTS

| | | | |
|---|---|---|---|
| 3,449,539 | 6/1969 | Scheffler et al. | 219/658 |
| 3,581,872 | 6/1971 | Grossjohann | 198/472.1 |
| 4,017,704 | 4/1977 | Collins, III et al. | 219/660 |
| 4,113,609 | 9/1978 | King et al. | 209/609 |
| 4,136,781 | 1/1979 | Perry et al. | 209/552 |
| 4,160,891 | 7/1979 | Scheffler | 219/658 |
| 4,272,313 | 6/1981 | Mori et al. | 156/262 |
| 4,315,568 | 2/1982 | Mojden | 198/690.1 |
| 4,333,246 | 6/1982 | Sullivan et al. | 34/418 |
| 4,358,236 | 11/1982 | Dudley | 414/795.3 |
| 4,481,397 | 11/1984 | Maurice et al. | 219/645 |
| 4,531,037 | 7/1985 | Camus | 219/648 |
| 4,539,456 | 9/1985 | Mohr | 219/604 |
| 4,673,781 | 6/1987 | Nuns et al. | 219/632 |
| 4,846,774 | 7/1989 | Bell | 493/87 |
| 5,325,601 | 7/1994 | Brownewell et al. | 34/247 |

FOREIGN PATENT DOCUMENTS

| | | |
|---|---|---|
| 0067235 | 12/1982 | European Pat. Off. . |
| 56-30048 | 3/1981 | Japan . |
| 2111815 | 4/1990 | Japan . |

OTHER PUBLICATIONS

Fleetwood Downstacker "On Sale" (see attached description).

*Primary Examiner*—Tu Hoang
*Attorney, Agent, or Firm*—Fleisler, Dubb, Meyer & Lovejoy

[57] ABSTRACT

Apparatus for spacing a plurality of substantially plate-like ferromagnetic workpieces such as can lids, in face-to-face relationship along a row, comprises a plurality of magnetic elements, each extending longitudinally along the row and different ones of the elements being disposed at different angular positions around the row, each of the magnetic elements being disposed and oriented to prevent the workpieces from pivoting about a distal edge of the workpiece due to the combined magnetic attraction of the workpiece by all others of the magnetic elements.

60 Claims, 8 Drawing Sheets

MAGNETIC SEPARATOR

This application is a continuation-in-part of U.S. patent application Ser. No. 07/832,987, filed Feb. 10, 1992, which is a continuation-in-part of U.S. patent application Ser. No. 07/621,231, filed Nov. 30, 1990, abandoned, which is a continuation-in-part of U.S. patent application Ser. No. 07/532,945, filed Jun. 4 1990, abandoned. The above three patent applications are owned by the assignee of the present application and are hereby incorporated by reference.

BACKGROUND OF THE INVENTION

1. Field of the Invention

The present invention relates to a technique for magnetically separating and moving plate-like metal objects such as metal can lids (closures, ends) for drying, curing or other purposes.

2. Description of Related Art

Closures for metal beverage containers are generally of a circular shape with a flanged perimeter called a curl. The closures are usually made of aluminum or steel, and the curl is used in attaching the closure to a can body through a seaming operation. To aid the integrity of the seal thus formed between the can body and the closure, it is a common practice to apply a bead of sealant or adhesive ("compound") within the curl during manufacture of the closure. Different types of coatings are also selectively or generally applied to can closures and can bodies for various other purposes as well, for example, to repair damaged coatings. For the purposes of the present description, coatings, sealants and adhesives are all considered to be "liquids" applied to a workpiece.

One problem which arises in this manufacturing operation is the curing or drying of such liquids. Recently there has been increased interest in the use of water-based sealants in the container industry, which may take 3–4 days to dry to an acceptable state for application of the closure to a can body. This was not a severe problem for solvent-based liquids, because the volatile solvent quickly evaporates and is acceptably dry for application of the closure to a can body typically within 48 hours.

In the past, can closures were heated to aid the drying or curing process typically either by infrared radiation or convection heating. These systems, especially the convection heating systems, tended to be large, bulky and expensive to operate due to inefficient energy usage. The parent applications describe a system for heating can ends inductively.

Since the present invention may be useful for most, if not all, of the various operations during manufacture, including application of liquids, drying of such liquids, and even transportation of closures from one station to the next, all such operations may be referred to herein collectively as "treatments".

Metal can closures are typically conveyed through treating apparatus in either of two ways. They can be conveyed by a conveyor belt, in which case the closures lie flat on the belt or they can be stacked within a track or cage, in abutting face-to-face contact with each other ("in-stick"). The former technique is exemplified in Collins U.S. Pat. No. 4,017,704. In the latter technique the closures are pushed through the apparatus in a direction transverse to their faces. Treating of can ends being pushed through in-stick would require less floor space since many more can ends can be packed into a given length of track. The technique is not often used in heat treating apparatus because convection air currents cannot heat or dry the faces of the can ends directly.

Sullivan U.S. Pat. No. 4,333,246 attempts to address this problem in the context of convective drying techniques. In Sullivan, the workpieces are pushed through a curvilinear path defined by a constant width trackwork, allowed to pivot on the portions of the workpieces in proximity to the shorter radiuses whereby fan-like separation of the portions in proximity to the longer radius occurs. Sullivan uses this trackwork to partially separate can ends as heated air is directed toward the separated portions.

The Sullivan technique has a number of major disadvantages. First, though one portion of each of the workpieces is separated from the other workpieces, there is always another portion of the workpieces (the portions in proximity to the shorter radiuses) which are touching other workpieces. The pieces are only fanned, not truly separated. Thus, if the apparatus is being used to cure liquids applied selectively on can ends, for example, it can be used only where the selectively applied liquid has been applied somewhere other than around the circumference where the ends are likely to touch each other. Additionally, the pressure on the portions of the ends which do touch each other, caused by the forces pushing the ends along the track, can soften and/or damage the metal of the ends or their coating. Moreover, the Sullivan apparatus can generate only limited separation between the fanned portions of the can ends, since greater separation requires tighter curves in the trackwork, which in turn requires greater force and stronger materials in the equipment which pushes the ends along the track. Nor can the technique be used for long conveyance paths, for the same reason, even if the curves are kept shallow. Still further, Sullivan's technique will not work well with can ends which have pull rings, since these can ends do not nest well and are likely to scratch each other if they touch.

SUMMARY OF THE INVENTION

Accordingly, it is an object of the present invention to provide apparatus which overcomes some or all of the above disadvantages.

According to the invention, roughly stated, apparatus for spacing a plurality of substantially plate-like ferromagnetic workpieces such as can ends, in face-to-face relationship along a row, comprises a plurality of magnetic elements, each extending longitudinally along the row and different ones of the elements being disposed at different angular positions around the row, each of the magnetic elements being disposed and oriented to prevent the workpieces from pivoting about a distal edge of the workpiece due to the combined magnetic attraction of the workpiece by all others of the magnetic elements.

BRIEF DESCRIPTION OF THE DRAWINGS

The invention will be described with respect to particular embodiments thereof, and reference will be made to the drawings, in which.

DETAILED DESCRIPTION

Figure 1:
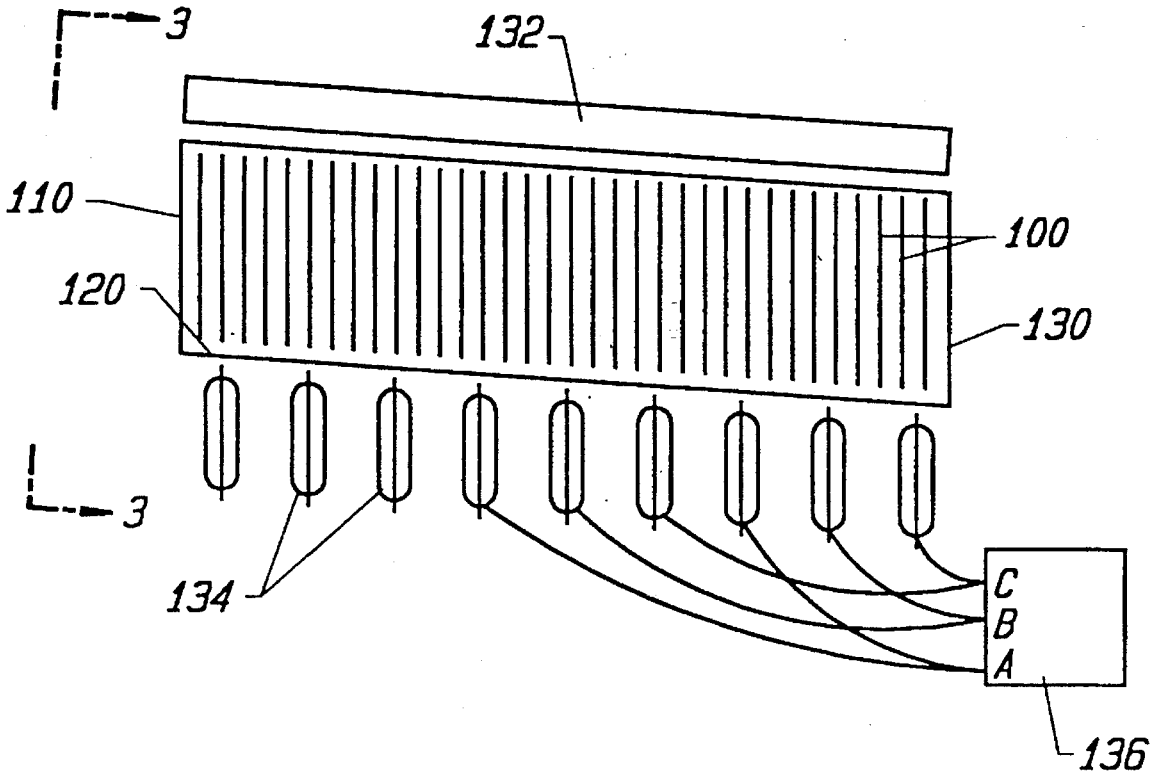
FIGS. 1 and 2 are a side view and a cross-section, respectively, of apparatus using magnetic spacing techniques.

It is well known that a plurality of magnetic objects free to move within a magnetic field, will spread out to share the entire available magnetic field equally. In the context of an induction heating station for can ends, a plurality of permanent rail or channel magnets oriented longitudinally along the length of a tube enclosing a conveyance path, may be located at different angular positions around a circumference of the tube. The magnets are located within the gaps between four regions of spirals making up the induction coil. The permanent magnets are oriented to provide alternating magnetic north and south poles around the circumference of the tube. The apparatus further includes a vibrator to mechanically vibrate the permanent magnets axially (longitudinally).

In operation, when a particular number of can ends are inside the tube, they will try to equally share the magnetic fields generated by the permanent magnets along the length of the tube. Friction is overcome by the mechanical vibrator, which vibrates the magnets, and therefore the magnetic fields generated by them, axially. Vibration can be achieved instead by other methods, such as by mounting guide rods defining the conveyance path on flexures and vibrating them axially, or by using the force oscillations inherent in the reversing field of the induction heating coil. Another alternative is to wrap a coil around the tube to provide a more slowly oscillating magnetic field specifically for vibrating the can ends. Vibrations would also be effective if transverse to the direction of travel.

With the can ends inside the tube and spaced apart by the magnetic fields generated by the permanent magnets, a medium frequency AC current is provided to the induction coil. A medium frequency AC magnetic field is thereby generated in each of the can ends inside the tube, which generates eddy currents to heat and dry them.

Although high temperatures are induced in the can ends themselves, the induction coil wiring remains cool. Also, since high temperatures are generally restricted to the ends themselves, and since the permanent magnets are substantially outside the fields generated by the induction coil, the permanent magnets may be inexpensive air cooled ceramic magnets instead of expensive magnets made of a high-curie-temperature material. Furthermore, use of inexpensive ceramic magnets instead of other types of magnets prevents the induction coil from inducing eddy currents in the magnets themselves since they are substantially electrically nonconductive. Note that AC or DC electromagnets may also be used instead of permanent magnets to accomplish spacing.

As long as no other forces are applied, the can ends in the tube will simply space out to share the field generated by the permanent magnets. A motivating force or moving means further may be provided to move the ends longitudinally along the path of travel. One way to apply such a force would be to tilt the tube such that the entrance end is higher than the exit end. This method uses gravity to skew the distribution of can ends along the length of the tube, so that they are spaced more closely together as they move toward the exit. When the ends reach some maximum packing density at the exit, the magnetic fields generated by the permanent magnets will no longer be strong enough to overcome the gravitational tendency of the end which is closest to the exit to fall out of the tube. Accordingly, for a given number of can lids desired in the tube at once, and for given magnetic field strengths generated by the spacer magnets, a tilt angle can be determined at which whenever one lid is added at the entrance of the tube, another lid falls out the exit. Thus as long as a method of overcoming friction is provided, a continuous flow of ends through the induction dryer can be maintained.

The lids can be motivated through the tube also by other means, such as by mechanically removing an end from the exit of the tube also by other means, such as each time a new end is added to the entrance. For example, FIG. 1*a* shows an upstream conveyor belt 1000 transporting can lids to a magnetic upstacker which periodically adds a new can lid to the entrance of the tube. Each time such a new can end is added, a magnetic downstacker removes the can end then at the exit of the tube and places it on a downstream conveyor belt for further processing. Each time one end is added to the entrance and another end is removed from the exit, the remainder of the ends inside the tube 1004 automatically readjust their longitudinal positions to equally share the magnetic field generated by the permanent magnets. A rotating knife may also be used instead of the downstacker to remove individual can ends from the exit end of the tube.

Another method for moving the can lids along the conveyance path in the tube is to cause them to move as if part of a linear induction motor.

Any of the above described moving techniques can be aided, if desired, by strategic placement or orientation of the separator magnets. For example, they may be slanted away from the tube toward the exit end thereof. This reduces the separating magnetic field within the tube at the exit end, and thereby permits the ends to space themselves less densely toward the exit end of the tube. This technique for controlling the density of the ends at various points along the length of the tube may be used as desired for any purpose. For example, the technique might be useful if it in any way simplifies the process of removing can ends from the exit end of the tube.

Since the permanent magnets do not need to have a high curie temperature, they can be made of a flexible material. This permits the use of a curved tube which, though mainly horizontal, curves 90° at the entrance to form a vertical uptake. This technique effectively obviates any necessity for an upstacker. A similar curve at the exit of the tube 700 can obviate any need for a downstacker.

Figure 1A:
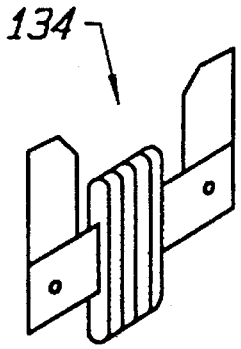
FIG. 1A is a perspective view of a solenoid shown in FIGS. 1 and 2.

FIG. 1 illustrates an arrangement in which can ends are spaced apart magnetically, and moved magnetically along a conveyance path, but no induction heating takes place. In the apparatus, can ends 100 (shown symbolically in FIG. 1) are fed in face-to-face orientation into an entrance 110 of a tube 120. The exit end 130 of tube 120, though not required, is shown slightly lower than the entrance end 110 so that gravity may facilitate movement of the can ends from the entrance to the exit. The tube 120 therefore maintains the can ends in a row and it defines a conveyance path. A permanent separator magnet 132 is disposed longitudinally outside the top surface of the tube 120, and a series of electromagnets or solenoids 134 is disposed longitudinally outside and along the bottom surface of the tube 120. FIG. 1A is a perspective view of one of the solenoids 134.

Figure 2:
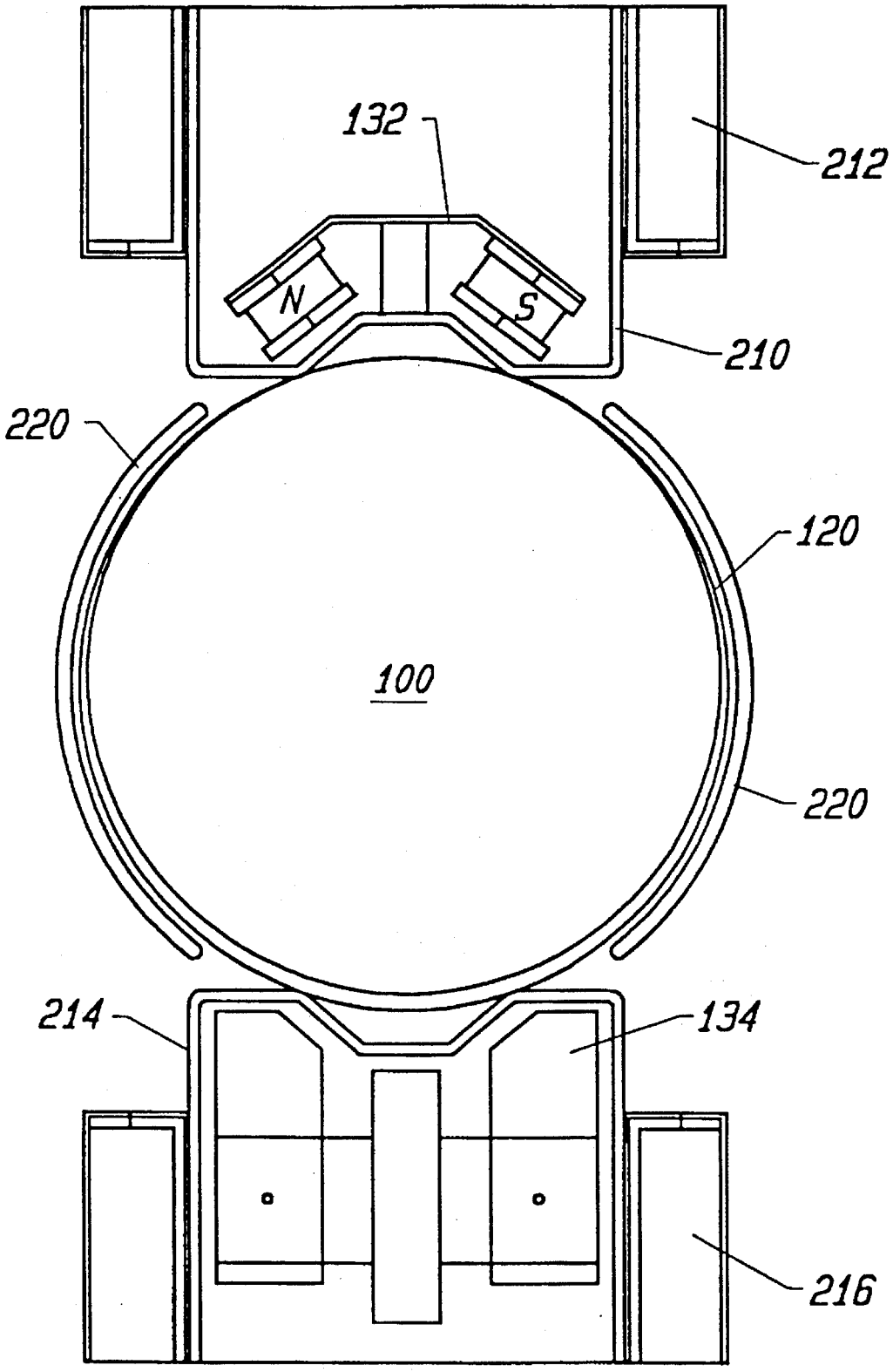
Figure 3:
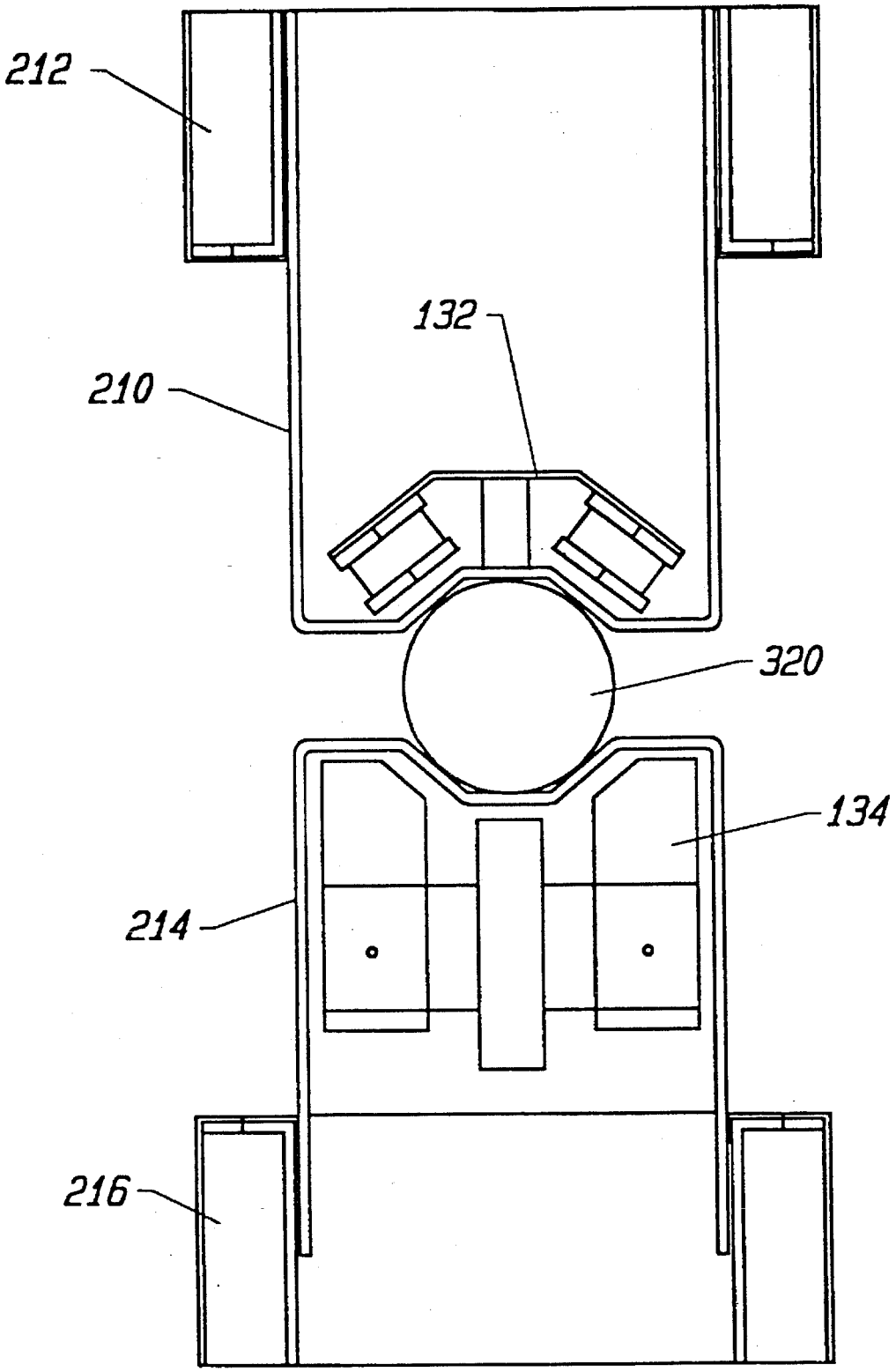
FIG. 3 is a cross-sectional view of the apparatus of FIGS. 1, 1A and 2 for use with a smaller tube.

FIG. 2 shows an end view of the apparatus of FIG. 1, taken along sight lines 2—2. In addition to one of the can ends 100, the permanent magnet 132, the tube 120 and one of the solenoids 134, the view of FIG. 3 also shows the mounting of the permanent magnet 132 and solenoids 134. In particular, permanent magnet 132 is attached to a frame 210 which can slide up or down to different positions within a bracket 212. Similarly, the solenoids 134 are attached to a frame 214 which can slide up or down to different positions within a bracket 216. FIG. 3 shows how the adjustability of the frames 210 and 214 cooperate with the shape of such frames to accommodate a smaller diameter tube 320 and, accordingly, smaller diameter can ends.

Returning to FIG. 1, a movement control circuit 136 is also provided which has a poly-phase output, having at least three phases A, B and C. The movement control circuit 136 generates three phases of pulse currents which drive the coils 134 in a sequentially interleaved manner. Any number of phases and interleaf factors can be used, but at least three phases are required to define a direction of motion.

In operation, the permanent magnet 132 attracts the can ends 100, which are ferromagnetic, so that their edges engage the inside top surface of tube 120. The permanent magnet 132 also has a separating effect as explained previously, but the ends 100 are for the most part prevented from moving axially if ends are introduced at the entrance and others removed at the exit, because of the frictional forces between the edges of the can ends 100 and the inside top surface of tube 120. The solenoids 134 act to attract the can ends away from the inside top surface of tube 120 momentarily whenever a pulse from movement control circuit 136 is applied to one of the solenoids 134. This facilitates the magnetic spacing produced by permanent magnet 132. Additionally, since the solenoids 134 are energized in a poly-phase interleaved manner, the can ends 100 are gradually moved along the conveyance path toward the exit 130. The pulse frequency of movement control circuit 136 may be on the order of 20–250 Hz. Additionally, if it is desired to heat the can ends 100 inductively at the same time they are being moved by the solenoids 134, each of the pulses provided to the solenoids 134 may comprise a medium frequency burst, rather than a simple square wave pulse. Alternatively or additionally, pancake coils such as those shown as 220 only in FIG. 2, may be attached to the outside of tube 120 on the two opposite sides thereof. This coil wraps partially around the can ends 100 circumferentially, and may be energized with the same medium frequency current described above.

Figure 4:
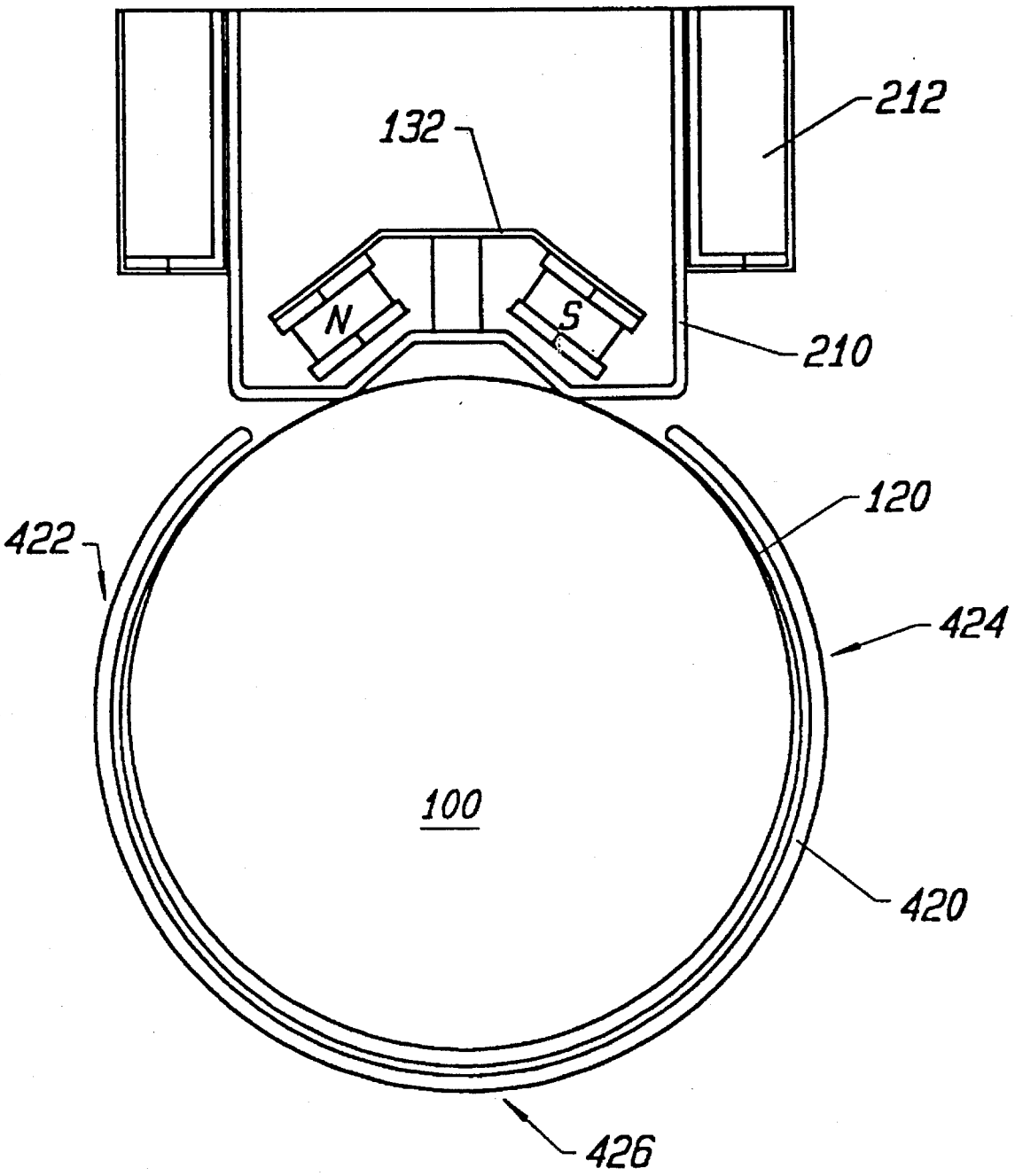
FIG. 4 is a cross-sectional view of a modification of the apparatus of FIGS. 1, 1A and 2.

Yet another alternative is shown in FIG. 4, in which the solenoids 134 are replaced by a pancake coil 420 wrapped substantially completely around a circumference of the tube 120. In particular, the pancake coil subtends the two opposite sides 422 and 424 and the bottom 426 of the conveyance path. Coil 420 may, if desired, be divided into a plurality of separately wound pancake sub-coils which are edge-adjacent around the circumference of the tube 120. Also, different ones of these coils 420 may be wrapped around longitudinally adjacent portions of the tube 120 in the same interleaved manner as the solenoids 134, and can be energized in poly-phase manner with medium-frequency pulse bursts. In this manner, pancake coils 420 will draw the can ends 100 away from the inside top surface of tube 120 to assist spacing, will motivate the ends toward the exit 130, and will inductively heat the can ends at the same time.

The linear motor motivational techniques described above also apply to aluminum workpieces, since the eddy currents induced in the workpieces generate a magnetic field oriented repulsively to the magnetic field generated by the wiring 422. Thus the workpiece and the wiring 422 form a repulsive linear motor, propelling the workpiece longitudinally along the inside of the tube 120. Moreover, whereas for ferromagnetic workpieces, the magnetic attraction of the workpieces to the wiring 422 may be so strong as to counteract the magnetic repulsive forces generated, this is not true with aluminum can lids. Thus, aluminum workpieces will be repelled inwardly from all sides of the tube with substantial uniformity, forcing them into the middle of the tube and thereby minimizing friction as the workpiece is propelled longitudinally. Aluminum workpieces can also be propelled by a poly-phase linear propulsion motor formed with a poly-phase winding.

Figure 5:
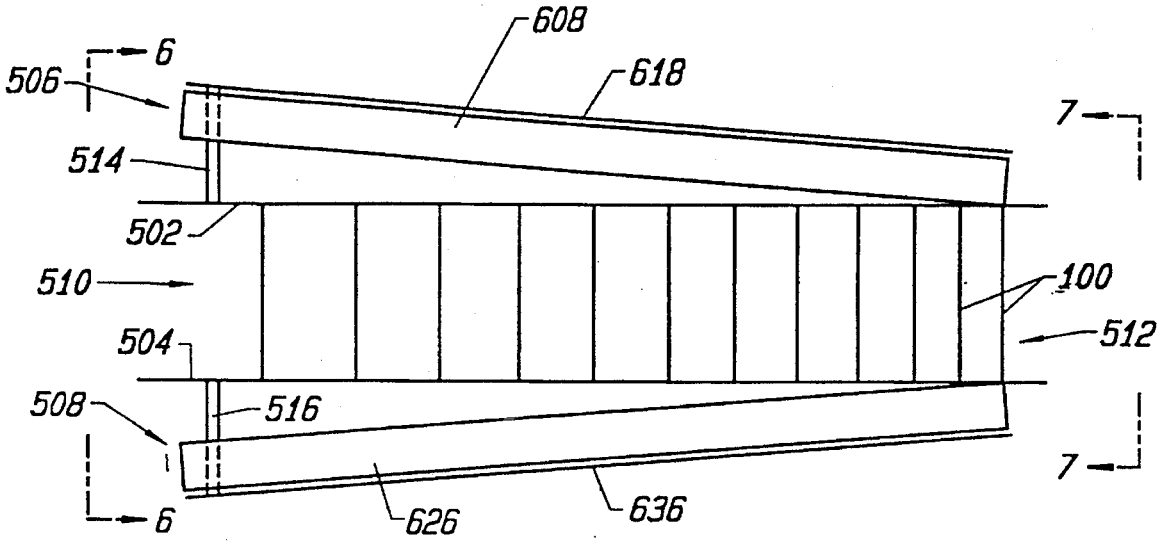
FIGS. 5, 6 and 7 are side, front and rear views, respectively, of apparatus according to the invention.

FIG. 5 is a symbolic side view of magnetic separator apparatus which does not require vibration. It comprises two retaining walls 502 and 504, respectively, above and below a horizontal row of can ends 100. Mounted above retaining wall 502 is a magnetic element 506, and mounted below retaining wall 504 is a magnetic element 508. Although not required in a different embodiment, magnetic element 506 is slanted with respect to the retaining wall 502 such that the element 506 is radially farther from the can ends 100 at an input end 510 of the row than it is at an exit end 512 of the row. Similarly, the magnetic element 508 is slanted with respect to the remaining wall 504 so as to be radially farther from the can ends 100 at the input and 510 of the row than it is at the output end 512 of the row. The magnetic elements 506 and 508 are held at the desired spacing from the respective retaining walls 502 and 504 by respective spacers 514 and 516, which may be made adjustable in a conventional manner.

Figure 6:
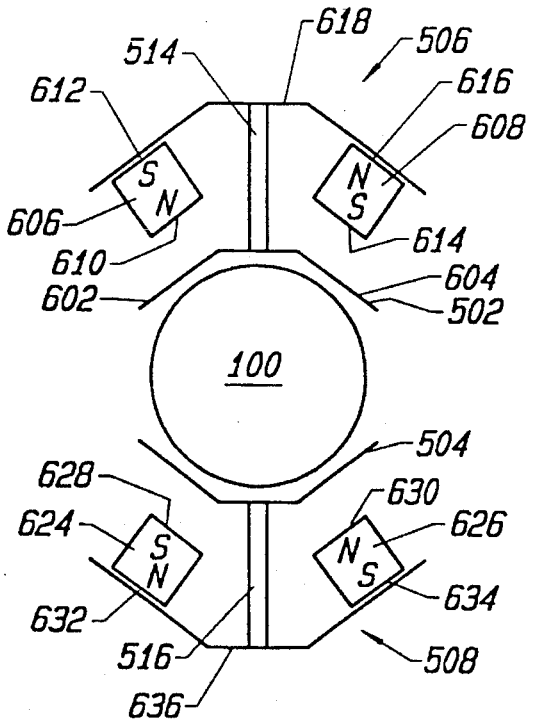

FIG. 6 is a front view of the apparatus of FIG. 5, taken along sight lines 6—6. As can be seen, retaining wall 502 has an upside-down V-shaped cross section. Although the exact shape is not critical to the invention, the V shape is advantageous since it helps to keep the can ends 100 centered horizontally when they are attracted toward the magnetic element 506. The edge of a can end 100 which is closest to the magnetic element 506 (in this case, the top edge of can end 100) abuts the two slanted portions 602 and 604 when the end 100 is drawn toward the magnetic element 506.

The magnetic element 506 comprises two permanent magnets 606 and 608 extending in parallel to each other, and longitudinally along the row of can ends 100. The lower surface 610 has one magnetic pole, e.g. north, and the upper surface 612 of the magnet 606 has the opposite magnetic pole. The lower surface 614 of the magnet 608 has the magnetic pole which is opposite to that of the surface 610, i.e. south, and the top surface 616 of the magnet 608 has the same magnetic polarity as that of the bottom surface 610 of magnet 606. The top surfaces of magnets 606 and 608 are attached to an upside-down V-shaped pole piece 618, which may be made of a magnetic material such as steel. The spacer 514 is attached from the pole piece 618 to the retaining wall 602.

Magnetic element 508 is similar to magnetic element 506, except it is inverted. It comprises a retaining wall 504, as well as longitudinally extending and parallel magnets 624 and 626, having respective upper surfaces 628 and 630 and respective lower surfaces 632 and 634. The magnets 624 and 626 are attached by their lower surfaces to a pole piece 636, and the spacer 516 is attached between the pole piece 636 and the retaining wall 504. The retaining walls 502 and 504 are preferably made of a non-magnetic material, such as an appropriate form of stainless steel. Moreover, the inside surfaces of the retaining walls 502 and 504 (i.e. the surfaces facing the row of can ends 100) may be chrome plated to reduce friction and minimize wear as the can ends 100 move longitudinally along the row.

Figure 7:
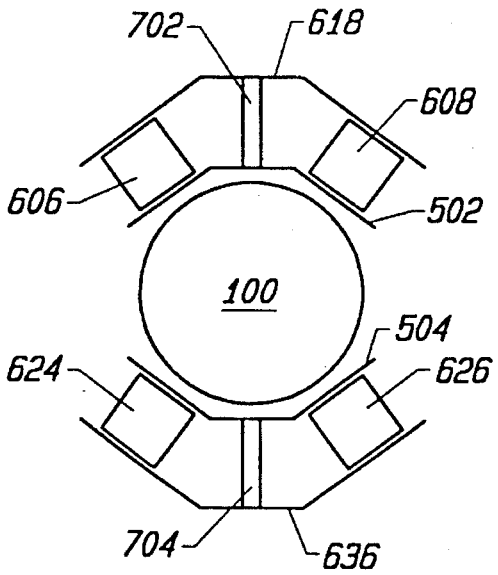

FIG. 7 shows a rear view of the apparatus of FIG. 5, taken along sight lines 7—7. The view is similar to that of FIG. 6, except that at this end of the row of can ends 100, the magnets 606 and 608 contact the retaining wall 502 and the magnets 624 and 626 contact the retaining wall 504. Additionally, a spacer 702 maintains the retaining wall 502 in position relative to the pole piece 618 at the rear end 512 of the row, and a spacer 704 maintains the retaining wall 504 in position relative to the pole piece 636 at the rear end of the row. As with spacers 514 and 516, spacers 702 and 704 may be made adjustable. The magnets 624 and 626 are oriented so that all of the magnetic poles which face the can ends 100, alternate polarity around a circumference of the row of ends.

In operation, as can ends are supplied at the input end 510 of the row of can ends, all of the can ends in the row space out horizontally to share the magnetic fields generated by the magnetic elements 506 and 508. A can end may be removed from the exit end 512 each time a new end is added to the input end 510, in order to effect movement. The top magnetic element 506 is positioned and oriented with respect to the can lids such that at each longitudinal position along the row at which a can can end is located, the magnetic attractive force which is due to the top magnetic element 506 is sufficient to prevent the can can end from pivoting about the opposite (distal) edge of the can end due to the magnetic attractive force of the bottom magnetic element 508. Similarly, the magnetic element 508 is positioned and oriented such that at each longitudinal position along the row at which a can can end is located, the magnetic attractive force which is due to the bottom magnetic element 508 is sufficient to prevent the can ends from pivoting about the upper (distal) edge due to the magnetic attractive force of the magnetic element 506. It is not necessary that the magnetic attractive forces of the two magnetic elements be so perfectly equal at each longitudinal position along the row as to suspend a can can ends 100 centered between them. Rather, a given can can ends 100 will be attracted toward whichever one of the magnetic elements 506 or 508 happens to be generating a stronger magnetic force at that time, and will be prevented from moving radially toward that magnetic element when the edge of the can end engages the intervening retaining wall 502 or 504.

As mentioned, the slanting of the magnetic elements 506 and 508 relative to the retaining 502 and 504 is not essential to the invention, but it does accomplish two purposes. First, since the slanting causes the magnetic field to be weaker at the input end 510 of the row of ends than at the exit end 512, the ends 100 will space themselves more widely at the input end than at the exit end. This is illustrated in FIG. 5. Wide spacing at the input end is useful in situations where it is important that the ends do not touch each other, for example after the application of a repair coat.

Second, the increasing magnetic flux strength toward the exit end of the path helps to motivate the can ends from the input end 510 toward the exit end 512. This is useful especially at the conclusion of a manufacturing run, when the apparatus becomes "self-unloading". That is, even if no more can ends are being added at the input end 510 of the row, each removal of a can can end at the exit end 512 moves the remainder of the ends in the row toward the exit end 512 until the last end in the row is accessible from the exit end 512. The slant of the magnetic elements can be adjusted to ensure that the last can end will settle closely enough to the exit end 512 for it to be picked up by the removing apparatus (e.g. magnetic wheel).

It should be noted that motivation of the can ends from the input end 510 toward the output end 512 can be aided by forcing air in the input end 510. This technique is especially useful where the forced air will also help to dry or cure a liquid which has been applied to the ends 100.

Each of the magnets 606, 608, 624 and 626 may be a strip magnet, such as Model No. 835HF, manufactured by Dowling Miner Magnetics Corp., Sonoma, Calif. Alternatively, it may be made of a series of end-adjacent magnets, such as Model No. 4898, manufactured by Dowling Miner Magnetics Corp.

As previously mentioned, magnetic separational and moving techniques can be used also in stations where inductive heating is also taking place. In such a situation, the retaining walls 502 and 504 may take the form of a tube (such as tube 120 in FIGS. 1, 2 and 4) about which the induction coil is wrapped. Additionally, the pieces 618 and 636 should either be removed or replaced by electrically non-conductive materials (or substantially electrically non-conductive materials) so as to minimize or prevent any eddy currents from being induced in the pole piece from the induction coil. If the pole pieces 618 and 636 are eliminated or made magnetically non-conductive, then either stronger magnets 606, 608, 624 and 626 should be used to obtain the same performance, or more than two magnetic elements should be used as described hereinafter. Additionally, while the magnets will not become inductively heated since they do not conduct a significant electrical current, they may become warm due to their proximity to the induction coils. The magnets should therefore be cooled using conventional convective cooling techniques. Advantageously, the same airflow which cools the induction coil can also cool the magnets.

Figure 8:
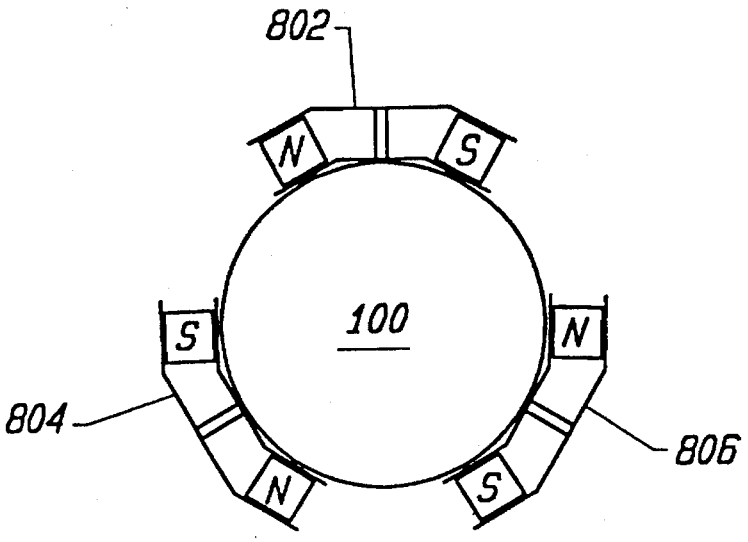
FIG. 8 is a rear view of another apparatus according to the invention.

As previously mentioned, the magnetic separation and moving technique described herein can be used with more than two magnetic elements placed circumferentially around the row of ends 100. FIG. 8 shows an end view of apparatus which uses three of such magnetic elements 802, 804 and 806. In this embodiment, the magnetic elements are disposed at equal angular positions around the circumference, but in another embodiment, this may not be necessary. As with the two-element embodiment of FIGS. 5, 6 and 7, each of the elements 802, 804 and 806 is disposed and oriented to substantially counterbalance radially, the combined radial magnetic attraction of the workpiece edge nearest the particular element, by both of the other magnetic elements. That is, at each longitudinal position at which a can end may be located along the row, each of the magnetic elements is disposed and oriented in such a manner as to prevent such a workpiece from pivoting about a distal edge of the workpiece due to the combined magnetic attraction by both of the other magnetic elements.

Note that regardless of the number of magnetic elements disposed circumferentially around the row of can ends, it is desirable to avoid disposing any of the magnetic elements directly below the row if the apparatus is intended to carry can ends to which a liquid has recently been applied and which may drip. This is shown in FIG. 8 in the three-element embodiment. In a two-element embodiment, the magnetic elements may be placed on opposite sides (left and right) of the row rather than above and below the row.

Figure 9:
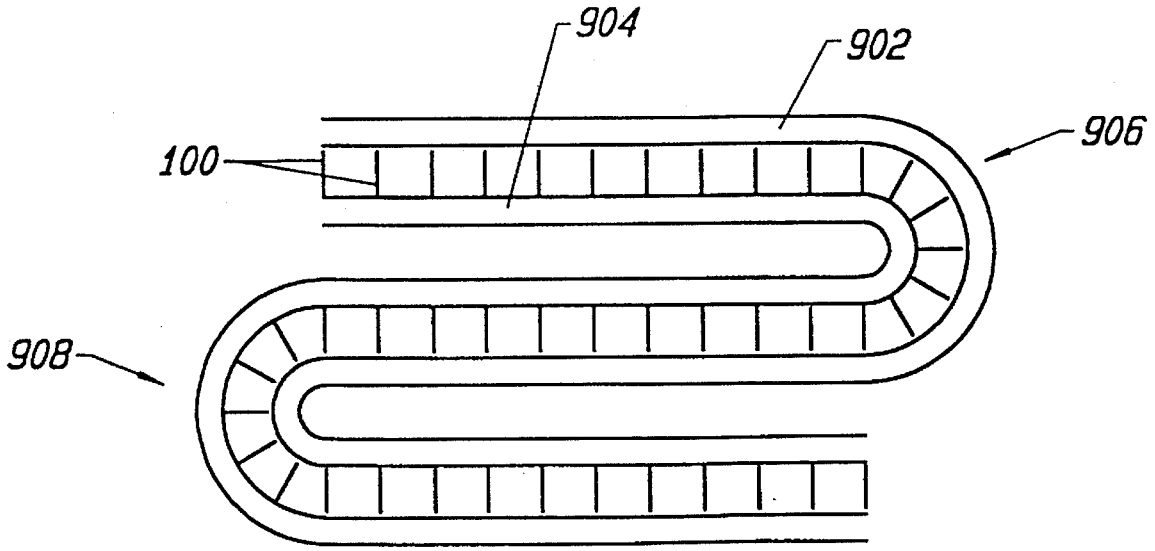
FIG. 9 is a side view of another apparatus according to the invention.
Figure 10:
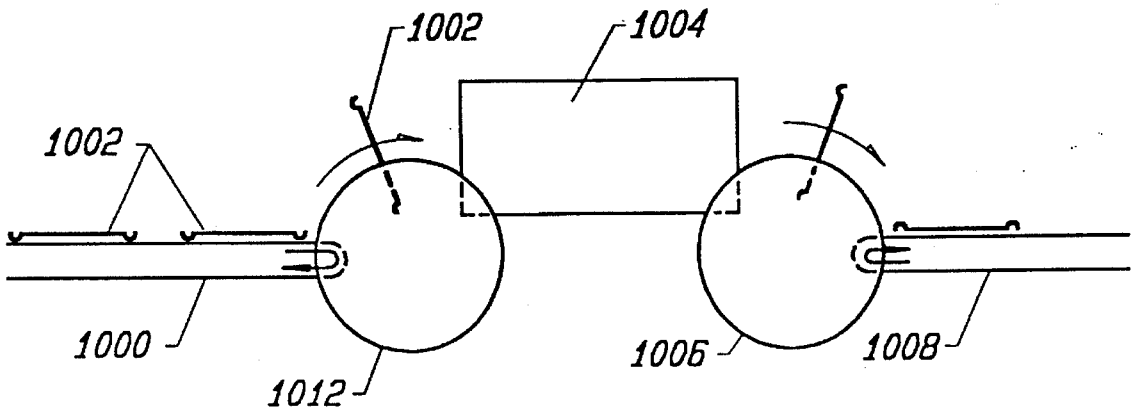
FIG. 10 is a side view of apparatus incorporating the invention.

FIG. 9 shows another variation, in which two magnetic elements 902 and 904 are used. The conveyance path for the ends 100 includes two curvilinear portions 906 and 908 as well as several straight portions. Such an arrangement is useful, for example, to provide nine linear feet of drying space in only three linear feet of floor space. In this case, the relative strengths of the magnetic elements 902 and 904 are adjusted in the curvilinear portions 906 and 908 in order to maintain the magnetically balanced condition described above at each longitudinal position along the conveyance path, including in the curvilinear portions.

Figure 11:
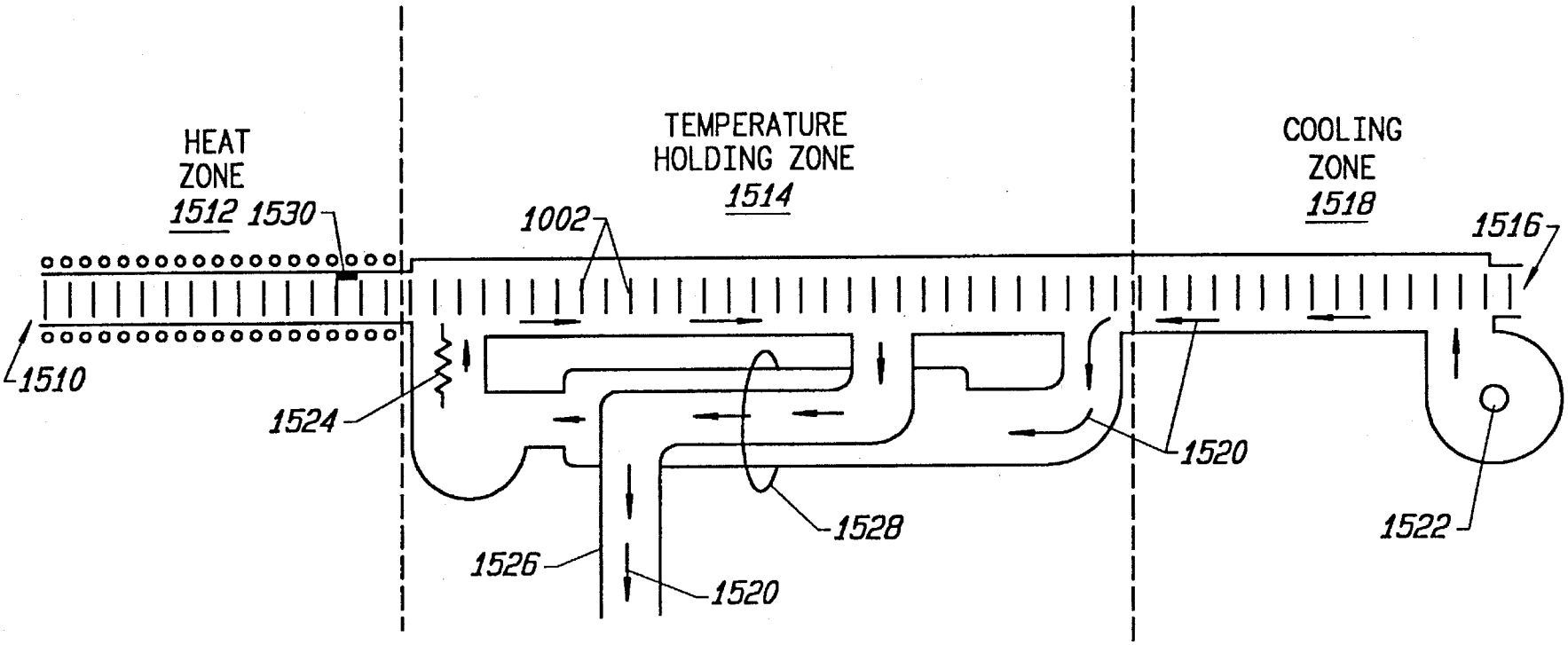
FIG. 11 is a side view of another embodiment of the invention.

FIG. 11 shows an overall system for drying liquids applied to can ends 1002. The ends are pushed into an entrance 1510 of a heating zone 1512 which may, for example, be 32 inches long. In the heating zone 1512, the ends are inductively heated.

The ends then enter a temperature holding zone 1514, in which they are spaced apart magnetically and moved magnetically toward an exit 1516 of the apparatus, both using the principles described above. The ends are not heated inductively in the temperature holding zone 1514, but instead air is circulated between them in a manner hereinafter described.

As the ends leave the temperature holding zone 1514, they enter a cooling zone 1518 which, like the temperature holding zone 1551, separates the ends magnetically and moves them magnetically toward the exit 1516 using the principles described above.

Arrows 1520 show the direction of air flow in the apparatus of FIG. 11. A blower 1522 blows room temperature air into the tube in the cooling zone 1518 from near the exit 1516. The air travels toward the temperature holding zone 1514, and as it does so, it simultaneously cools the ends in the cooling zone 1518 and picks up heat for use in the temperature holding zone 1514. Upon entering the temperature holding zone 1514, the air is directed through the tube containing the can ends into a heat exchanger 1528, heated by a resistive heater 1524, and supplied back to the temperature holding zone 1514 near the entrance of that zone. The hot air then flows through the tube containing the can ends in the temperature holding zone 1514 in the same direction that the ends are moving, where it scrubs off evolved moisture from the can ends. The air then flows out an exhaust pipe 1526 from a point near the downstream end of the temperature holding zone 1514. The heat exchanger 1528 may be provided to couple heat from the exhaust pipe 1526 into the air flowing to the resistive heater 1524 in order to help conserve energy.

The invention has been described with respect to particular embodiments thereof, and numerous variations are possible within its scope. For example, the invention is not limited to metal can closures, but can also be used with other, plate-like ferromagnetic workpieces. Many other variations will be apparent.

We claim:

1. Apparatus for spacing a plurality of substantially plate-like workpieces in face-to-face relationship along a substantially horizontal row, which workpieces are influenced by magnetic forces, said apparatus comprising a plurality of magnetic elements, each extending longitudinally along said row and being substantially horizontally oriented and disposed at different angular positions around said row, each particular one of said magnetic elements being disposed and oriented to prevent each given one of said workpieces from pivoting about a distal edge of said given workpiece due to the combined magnetic attraction of said given workpiece by all of said magnetic elements other than said particular magnetic element, said magnetic elements operating to space said workpieces apart along said row.

2. Apparatus according to claim 1, wherein said workpieces comprise can ends.

3. Apparatus according to claim 1, wherein each particular one of said magnetic elements comprises a pair of opposite magnetic poles each extending longitudinally and substantially parallel to each other along said particular magnetic element, said poles being oriented to create a magnetic flux path passing through said row.

4. Apparatus according to claim 3, wherein the poles of said magnetic elements alternate magnetic polarities circumferentially around said row.

5. Apparatus according to claim 3, wherein each particular one of said magnetic elements comprises first and second permanent magnets each extending longitudinally and substantially parallel to each other along said particular magnetic element, said first permanent magnet having a north pole directed radially toward said row and further having a south pole, and said second permanent magnet having a south pole directed radially toward said row and further having a north pole.

6. Apparatus according to claim 5, further comprising:

an induction coil at least partly enclosing said row circumferentially; and a source of medium frequency oscillating electrical current coupled to said induction coil, wherein said first and second permanent magnets in each of said magnetic elements have low electrical conductance.

7. Apparatus according to claim 5, wherein each particular one of said magnetic elements further comprises a pole piece magnetically coupling the south pole of the first permanent magnet to the north pole of the second permanent magnet of the particular magnetic element along substantially the entire length of said row.

8. Apparatus according to claim 1, further comprising a retaining surface disposed between a particular one of said magnetic elements and said row of workpieces such that an edge of one of said workpieces, which edge is proximate to the particular magnetic element and is attracted radially toward said particular magnetic element, is engaged by said retaining surface and prevented from reaching said particular magnetic element.

9. Apparatus according to claim 8, wherein said retaining surface is nonmagnetic.

10. Apparatus according to claim 8, wherein said retaining surface is smooth to facilitate longitudinal motion relative to said retaining surface of edges of said workpieces which engage said surface.

11. Apparatus according to claim 1, further comprising a non-magnetic retaining surface disposed between each of said magnetic elements and said row of workpieces such that an edge of one of said workpieces which is attracted radially toward a particular one of said magnetic elements is engaged by one of said retaining surfaces and prevented from reaching the particular magnetic element, each of said retaining surfaces being smooth to facilitate longitudinal motion relative to said retaining surfaces of said workpieces while edges of said workpieces engage said surface.

12. Apparatus according to claim 1, wherein said workpieces are ferromagnetic.

13. Apparatus according to claim 1, wherein none of said plurality of magnetic elements is disposed directly below said row.

14. Apparatus according to claim 1, wherein said row has an input end and a longitudinally opposed exit end, further comprising means for adding workpieces to said input end and means for removing workpieces from said exit end, to thereby move workpieces along said row in a direction from said input end toward said exit end.

15. Apparatus according to claim 14, further comprising means for forcing air longitudinally into said row from said input end.

16. Apparatus according to claim 1, further comprising mounting means for holding said magnetic elements radially closer to said workpieces at a first longitudinal position along said row, and radially farther from said workpieces at a second longitudinal position along said row.

17. Apparatus according to claim 16, wherein said first longitudinal position constitutes an exit end of said row and said second longitudinal position constitutes an input end of said row, further comprising means for adding workpieces to said input end and means for removing workpieces from said exit end, to thereby move workpieces along said row in a direction from said input end toward said exit end.

18. Apparatus according to claim 1, wherein said row is substantially straight.

19. Apparatus according to claim 1, wherein said row includes a curved segment.

20. Apparatus for magnetically spacing a plurality of can ends in face-to-face relationship along a conveyance path, said can ends each having two faces and a circumfential edge, said can ends including a material which is influenced by magnetic forces, said apparatus comprising:

a feeder which feeds said can ends into said conveyance path;

a first magnetic element extending longitudinally along said path, said first magnetic element having a north pole extending longitudinally along said path and directed substantially radially toward said path, said first magnetic element further having a south pole extending substantially parallel to said north pole of said first magnetic element and directed substantially radially toward said path; and a second magnetic element extending longitudinally along said path, said second magnetic element having a north pole extending longitudinally along said path and directed substantially radially toward said path, said second magnetic element further having a south pole extending substantially parallel to said north pole of said second magnetic element and directed substantially radially toward said path, said first and second magnetic elements opposing each other diametrically across said path, and being spaced substantially equally from said path radially at each longitudinal position along said path for operating to space can ends apart along said path.

21. Apparatus according to claim 20, wherein said first and second magnetic elements are mounted radially more closely to said path at one end of said path than at the other end of said path.

22. Apparatus according to claim 20, wherein said first magnetic element comprises:

a first permanent magnet having a north pole directed substantially radially toward said path and a south pole directed substantially radially away from said path;

a second permanent magnet having a south pole directed substantially radially toward said path and a north pole directed substantially radially away from said path; and a first material which conducts magnetic flux lines, disposed between the south pole of said first permanent magnet and the north pole of said second permanent magnet: along substantially the entire length of said first magnetic element, and wherein said second magnetic element comprises:

a third permanent magnet having a north pole directed substantially radially toward said path and a south pole directed substantially radially away from said path;

a fourth permanent magnet having a south pole directed substantially radially toward said path and a north pole directed substantially radially away from said path; and a second material which conducts magnetic flux lines, disposed between the south pole of said third permanent magnet and the north pole of said fourth permanent magnet along substantially the entire length of said second magnetic element.

23. Apparatus according to claim 20, further comprising a retaining surface disposed between each of said magnetic elements and said path such that edges of said can ends, when attracted radially toward one of said magnetic elements, are engaged by the retaining surface and prevented from reaching said one of said magnetic elements.

24. Apparatus for magnetically spacing a plurality of ferromagnetic can ends in face-to-face substantially horizontal relationship along a conveyance path, said can ends each having two faces and a circumferential edge, comprising:

a feeder which feeds said can ends into said conveyance path;

a first magnetic element extending longitudinally along said path, said first magnetic element including a first permanent magnet having a north pole directed substantially radially toward said path and a south pole directed substantially radially away from said path, a second permanent magnet having a south pole directed substantially radially toward said path and a north pole directed substantially radially away from said path, and a pole piece magnetically coupling the south pole of said first permanent magnet to the north pole of said second permanent magnet along substantially the entire length of said first magnetic element;

a second magnetic element extending longitudinally along said path, said second magnetic element including a third permanent magnet having a north pole directed substantially radially toward said path and a south pole directed substantially radially away from said path, a fourth permanent magnet having a south pole directed substantially radially toward said path and a north pole directed substantially radially away from said path, and a pole piece magnetically coupling the south pole of said third permanent magnet to the north pole of said fourth permanent magnet along substantially the entire length of said second magnetic element; and a retaining surface disposed between each of said magnetic elements and said path such that edges of said can ends, when attracted radially toward one of said magnetic elements, are engaged by the retaining surface and prevented from reaching said one of said magnetic elements, said first and second magnetic elements opposing each other diametrically across said path, and being spaced substantially equally from said path radially at each longitudinal position along said path, said first and second magnetic elements being mounted radially closer to said path at one end of said path than at the other end of said path for operating to space can ends apart along said conveyance path.

25. Apparatus for treating a plurality of ferromagnetic can ends, comprising:

means for holding said can ends in substantially horizontal relationship to each other; and magnetic means, extending longitudinally along said means for holding to produce a magnetic field passing through the can ends, to maintain said can ends in spaced, face-to-face relationship, and to cause said can ends to be magnetically spaced apart by sharing said magnetic field for maintaining said can ends in spaced, face-to-face relationship and spacing said can ends apart magnetically.

26. Apparatus according to claim 25, further comprising means for circulating air between said can ends.

27. Apparatus for spacing a plurality of substantially plate-like ferromagnetic workpieces in face-to-face relationship along a non-vertical row, comprising a plurality of magnetic elements, each extending longitudinally along said row, oriented substantially parallel to said row and disposed at different angular positions around said row, said magnetic elements being disposed and oriented to, and operating to, maintain said workpieces in face-to-face relationship due to a combined magnetic attraction of said magnetic elements.

28. Apparatus according to claim 25, wherein said means for holding includes a surface directly contacting said can ends, further comprising:

vibratory means for overcoming friction between said can ends and said surface.

29. Apparatus according to claim 25, wherein said can ends form a row of can ends, and wherein said magnetic means comprises channel magnets extending longitudinally along said row.

30. Apparatus according to claim 25, wherein said can ends form a row of can ends, and wherein said magnetic means comprises a flexible permanent magnet extending longitudinally along said row.

31. Apparatus according to claim 29, further comprising a surface extending longitudinally along said row, said magnets attracting said can ends to said surface, said apparatus further comprising vibration means for vibrating said can ends.

32. Apparatus according to claim 25, further comprising moving means for moving said can ends along a substantially horizontal path.

33. Apparatus according to claim 32, wherein said path is slanted slightly downward, and wherein said moving means operates at least in part gravitationally.

34. Apparatus according to claim 32, wherein said means for holding has an input end and an exit end, and wherein said moving means comprises:

means for adding can ends to said input end of said means for holding; and means for removing can ends from said exit end of said means for holding.

35. Apparatus according to claim 31, wherein said vibration means is further for moving said can ends magnetically and longitudinally in a direction in which they are spaced.

36. Apparatus according to claim 25, wherein said substantially horizontal relationship includes a slight slant downward by a predetermined angle to a horizontal plane of a conveyance path, further comprising means for adding can ends to the higher end of said slant, said particular angle being chosen such that one can end drops out the lower end of said slant in response to each addition of a can end to the higher end of said row.

37. Apparatus according to claim 25, wherein said can ends form a row of can ends oriented in face-to-face relationship, and when said means for holding and said magnetic means for spacing comprise:

a plurality of magnetic elements, each extending longitudinally along said row and being disposed at different angular positions around said row, each particular one of said magnetic elements being disposed and oriented to prevent each given one of said can ends from pivoting about a distal edge of said given can end due to a combined magnetic attraction of said given can end by all of said magnetic elements other than said particular magnetic element.

38. Apparatus for spacing a plurality of workpieces along a substantially horizontal row, comprising:

a first magnet extending longitudinally along said row; and mounting means for holding said first magnet closer to said row at a first longitudinal position along said row, and farther from said row at a second longitudinal position along said row.

39. Apparatus according to claim 38, further comprising a second magnet extending longitudinally along said row, said first and second magnets being disposed at different angular positions around said row, said mounting means being further for holding said second magnet closer to said row at said first longitudinal position along said row, and farther from said row at said second longitudinal position along said row.

40. Apparatus according to claim 38, wherein said workpieces are can ends.

41. Apparatus according to claim 25 further, comprising:

treating means for treating said can ends; and magnetic moving means for magnetically moving said can ends along a conveyance path through said treating means.

42. Apparatus according to claim 41, wherein said magnetic moving means comprises:

a plurality of electromagnets disposed longitudinally along said conveyance path; and control means for energizing said electromagnets sequentially.

43. Apparatus according to claim 42, wherein said control means energizes said electromagnets in at least three phases.

44. Apparatus according to claim 42, wherein said can ends are ferromagnetic, and wherein said control means energizes said electromagnets in a manner which attracts each of said can ends toward each next sequential one of said electromagnets.

45. Apparatus according to claim 42, wherein said can ends are aluminum, and wherein said control means energizes said electromagnets in a manner which repels each of said can ends away from one of said electromagnets toward the next sequential one of said electromagnets.

46. Apparatus according to claim 41, further comprising means for holding said can ends in substantially face-to-face relationship.

47. Apparatus according to claim 42, further for inductively heating said can ends, wherein said control means comprises means for energizing said electromagnets sequentially with bursts of AC current.

48. Apparatus according to claim 47, wherein said bursts of AC current each have a frequency between about 6 kHz and about 20 kHz.

49. Apparatus for handling a plurality of ferromagnetic can ends, comprising:

spacing means extending longitudinally along a conveyance path to produce a magnetic field for maintaining said can ends in substantially face-to-face relationship and to cause, said can ends to be magnetically spaced apart by sharing said magnetic field; and moving means for moving said can ends magnetically along said conveyance path.

50. Apparatus according to claim 49, further comprising means for holding said can ends in substantially horizontal relationship while being spaced and moved.

51. Apparatus according to claim 49, wherein said spacing means comprises a channel magnet extending longitudinally along said conveyance path, said can ends being maintained in face-to-face relationship and spaced along said conveyance path, further comprising a surface extending longitudinally along said conveyance path, said channel magnet attracting said can ends to said surface, and wherein said moving means comprises a plurality of sequentially energized electromagnets disposed longitudinally along said conveyance path, each of said electromagnets disposed to attract at least one of said can ends away from said surface when energized.

52. Apparatus according to claim 51, wherein said surface comprises a surface of said channel magnet.

53. Apparatus according to claim 51, wherein said surface comprises a portion of the inner surface of a tube extending longitudinally along and substantially enclosing said conveyance path.

54. Apparatus according to claim 41, comprising:

means for holding said can ends in face-to-face relationship along a curved course; and a flexible permanent magnet disposed longitudinally along said curved course.

55. Apparatus according to claim 16, wherein said mounting means is radially adjustable at one of said first and second longitudinal positions.

56. An oven for heating a plurality of substantially plate-like ferromagnetic workpieces disposed in face-to-face relationship along a row, comprising:

a plurality of magnetic elements, each extending longitudinally along said row and disposed at different angular positions around said row, each of said magnetic elements being disposed and oriented to, and being effective to, maintain said workpieces in spaced face-to-face relationship due to the combined magnetic fields of said magnetic elements; and a heater for heating said workpieces along said row.

57. Apparatus for spacing a plurality of ferromagnetic can ends in face-to-face relationship along a conveyance path, comprising:

a plurality of magnetic elements each extending longitudinally along said path, each given one of said magnetic elements having a north pole extending longitudinally along said path and directed substantially radially toward said path, and each given one of said magnetic elements further having a south pole extending substantially parallel to the north pole of the given magnetic element and directed substantially radially toward said path, said magnetic elements being disposed at different angular positions around said path in a manner which maintains said can ends in face-to-face relationship.

58. Apparatus according to claim 57, wherein said plurality of magnetic elements consists of two magnetic elements, said two magnetic elements opposing each other diametrically across said path and being spaced substantially equally from said path radially at each longitudinal position along said path.

59. Apparatus according to claim 20, wherein said can ends are made of a ferromagnetic material.

60. Apparatus according to claim 22, wherein said first material comprises a pole piece magnetically coupling the south pole of said first permanent magnet to the north pole of said second permanent magnet along substantially the entire length of said first magnetic element, and wherein said second material comprises a pole piece magnetically coupling the south pole of said third permanent magnet to the north pole of said fourth permanent magnet along substantially the entire length of said second magnetic element.

* * * * *

UNITED STATES PATENT AND TRADEMARK OFFICE

CERTIFICATE OF CORRECTION

PATENT NO. : 5,483,042

DATED : January 9, 1996

INVENTOR(S) : Robert A. Sprenger; Ray C. Raffa

It is certified that error appears in the above-indentified patent and that said Letters Patent is hereby corrected as shown below:

Col. 10, line 2, delete "the" and insert therefor --a--.

Col. 13, line 63, delete "the" and insert therefor --a--.

Col. 13, line 65, after "said", delete "particular".

Col. 13, line 66, delete "the" and insert therefor --at a--.

Column 13, line 67, delete "row" and the insert therefor —slant—

Col. 14, line 32, after "claim 25", insert --,-- and after "further", delete ",".

Col. 15, line 4, after "cause", delete ",".

Signed and Sealed this

Twenty-first Day of May, 1996

Bruce Lehman

*Attest:*

BRUCE LEHMAN

*Attesting Officer*

*Commissioner of Patents and Trademarks*